US009347751B2

(12) United States Patent
Hollars

(10) Patent No.: US 9,347,751 B2
(45) Date of Patent: May 24, 2016

(54) MECHANICAL BROADHEAD DEVICE

(71) Applicant: Anthony S. Hollars, Tucson, AZ (US)

(72) Inventor: Anthony S. Hollars, Tucson, AZ (US)

( * ) Notice: Subject to any disclaimer, the term of this patent is extended or adjusted under 35 U.S.C. 154(b) by 0 days.

(21) Appl. No.: 14/574,046

(22) Filed: Dec. 17, 2014

(65) Prior Publication Data

US 2015/0168112 A1 Jun. 18, 2015

Related U.S. Application Data

(60) Provisional application No. 61/916,955, filed on Dec. 17, 2013.

(51) Int. Cl.

| | |
|---|---|
| ***F42B 6/08*** | (2006.01) |
| ***F42B 12/34*** | (2006.01) |
| ***F42B 10/46*** | (2006.01) |

(52) U.S. Cl.
CPC . *F42B 12/34* (2013.01); *F42B 6/08* (2013.01); *F42B 10/46* (2013.01)

(58) Field of Classification Search
CPC ..... F42B 6/04; F42B 6/08
See application file for complete search history.

(56) References Cited

U.S. PATENT DOCUMENTS

| | | | | |
|---|---|---|---|---|
| 3,110,336 | A * | 11/1963 | Sukala, Jr. | 150/154 |
| 3,672,677 | A * | 6/1972 | Moore | 473/578 |
| 3,714,133 | A * | 1/1973 | Kawasaki et al. | 526/114 |
| 4,303,730 | A * | 12/1981 | Torobin | 428/333 |
| 5,803,845 | A * | 9/1998 | Anderson | 473/583 |
| 5,871,410 | A * | 2/1999 | Simo et al. | 473/583 |
| 6,394,919 | B1 * | 5/2002 | Ossege | 473/582 |
| 7,434,684 | B1 * | 10/2008 | Mabra | 206/315.11 |
| 2012/0279412 | A1 * | 11/2012 | Hash et al. | 102/506 |

* cited by examiner

*Primary Examiner* — John Ricci
(74) *Attorney, Agent, or Firm* — Dale F. Regelman; Quarles & Brady LLP

(57) ABSTRACT

A mechanical broadhead device which includes a plurality of blades pivotably attached to a shaft, where the plurality of blades and the shaft are disposed within a tapered cover, and an arrow comprising the mechanical broadhead device attached to an arrow shaft has an aerodynamic profile in flight that mimics an aerodynamic profile of an arrow comprising a target or field point.

23 Claims, 11 Drawing Sheets

MECHANICAL BROADHEAD DEVICE

CROSS REFERENCE TO RELATED APPLICATIONS

The is a Non-Provisional Application claiming priority to U.S. Provisional Patent Application having Ser. No. 61/916,955 filed Dec. 17, 2013, which is hereby incorporated by reference herein.

FIELD OF THE INVENTION

The invention is directed to a mechanical broadhead device for use with an arrow.

BACKGROUND OF THE INVENTION

The arrowhead or projectile point is the primary functional part of an arrow. Some arrows may simply use a sharpened tip of the solid shaft, but it is far more common for separate arrowheads to be made, usually from metal, horn, or some other hard material. Arrowheads are usually separated by function:

What is needed is a mechanical broadhead device that does not induce aerodynamic drag on an arrow in flight resulting from portions of the broadhead device extending outwardly from the outer surface of the arrow shaft into the surrounding ambient air.

BRIEF DESCRIPTION OF THE DRAWINGS

The invention will be better understood from a reading of the following detailed description taken in conjunction with the drawings in which like reference designators are used to designate like elements, and in which.

DETAILED DESCRIPTION OF PREFERRED EMBODIMENTS

Figure 1A:
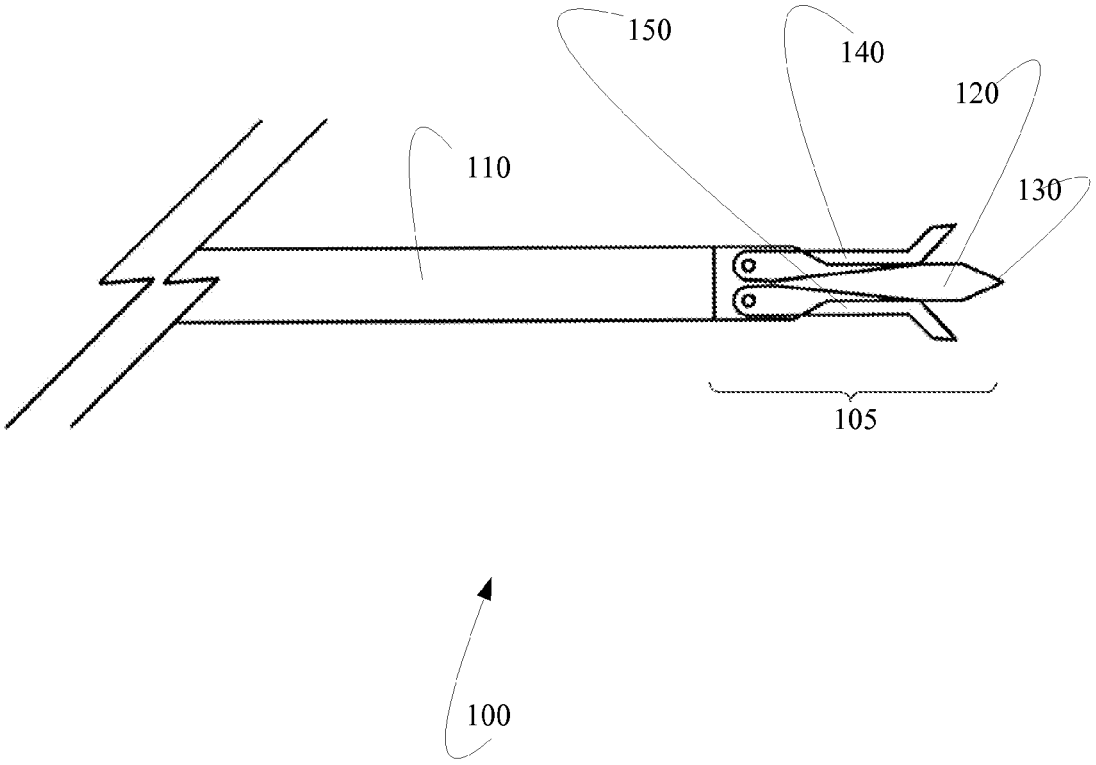
FIG. 1A (PRIOR ART)
FIGS. 1A and 1B illustrate prior art mechanical broadhead devices.

The invention is described in preferred embodiments in the following description with reference to the Figures, in which like numerals represent the same or similar elements. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

The described features, structures, or characteristics of the invention may be combined in any suitable manner in one or more embodiments. In the following description, numerous specific details are recited to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

An arrow is a shafted projectile that is shot with a bow. An arrow usually consists of a shaft with an arrowhead attached to the front end, with fletchings at the other.

Fletchings are found at the back of the arrow and act as airfoils to provide a small amount of force used to stabilize the flight of the arrow. They are designed to keep the arrow pointed in the direction of travel by strongly damping down any tendency to pitch or yaw. Fletching is sometimes attached with a slight angle from the centerline of the shaft causing rotation of an arrow in flight for stability similar to rifling in a gun barrel causing a bullet to spin for stability and accuracy.

Fletchings are traditionally made from feathers (often from a goose or turkey) bound to the arrow's shaft, but are now often made of plastic (known as "vanes").

Target points are bullet-shaped with a sharp point, designed to penetrate target butts easily without causing excessive damage to them. Field tips are similar to target points and have a distinct shoulder, so that missed outdoor shots do not become as stuck in obstacles such as tree stumps. They are also used for shooting practice by hunters, by offering similar weights as broadheads, without getting lodged in target materials and causing excessive damage upon removal.

Broadheads are used for hunting. Medieval broadheads could be made from steel, sometimes with hardened edges. They usually have two to four sharp blades that cause massive bleeding in the victim. Their function is to deliver a wide cutting edge so as to kill as quickly as possible by cleanly cutting major blood vessels, and cause further trauma on removal. They are expensive, damage most targets, and are usually not used for practice.

There are two main types of broadheads used by hunters: The fixed-blade and the mechanical types. While the fixed-blade broadhead keeps its blades rigid and unmovable on the broadhead at all times, the mechanical broadhead deploys its blades upon contact with the target, its blades swinging out to wound the target.

Figure 1B:
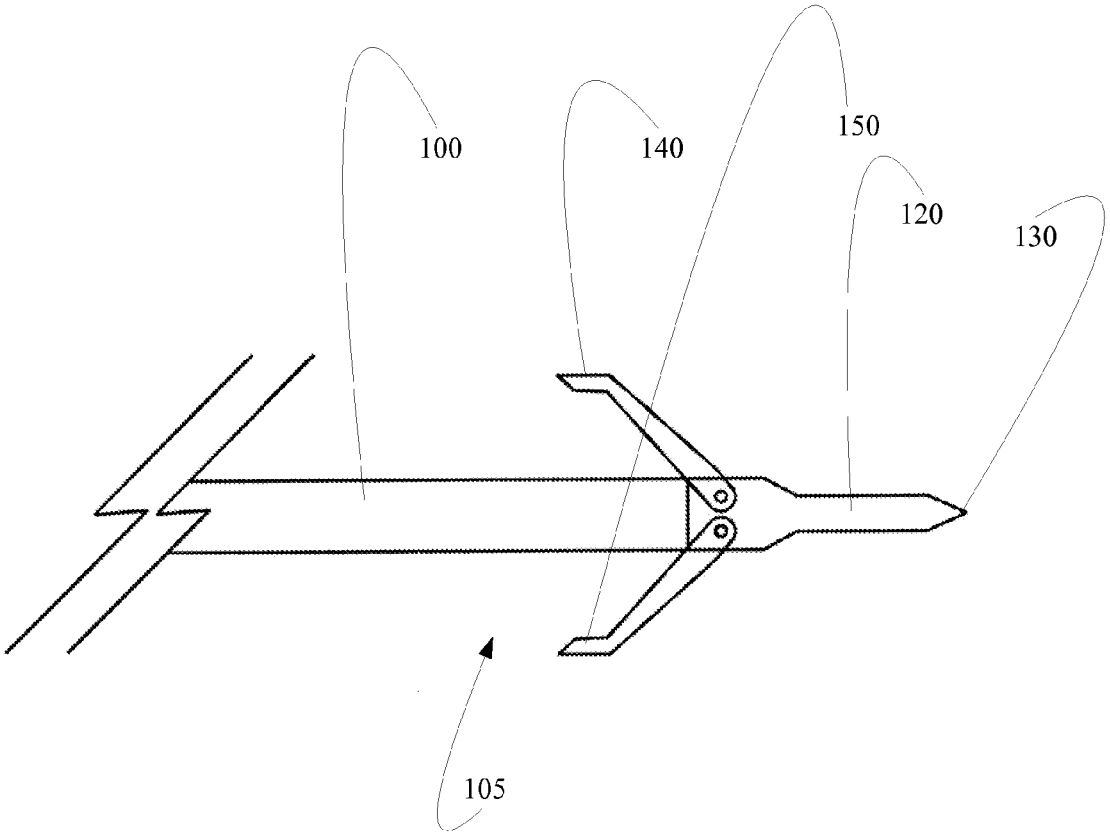
FIG. 1B (PRIOR ART)

Referring now to FIG. 1A, prior art mechanical broadhead 105 is shown comprising two movable blades 140 and 150. In embodiment 100 in FIG. 1A, blades 140 and 150 are not extended, and are partially disposed along the axis of shaft 110 behind a shaft 120 having a sharp point 130. Upon impact with a target, blades 140 and 150 pivot outwardly. FIG. 1B illustrates prior art broadhead 105, wherein blades 140 and 150 shown deployed outwardly. When front blade 120 impacts a target, the pivotable blades extend outwardly.

Figure 2:
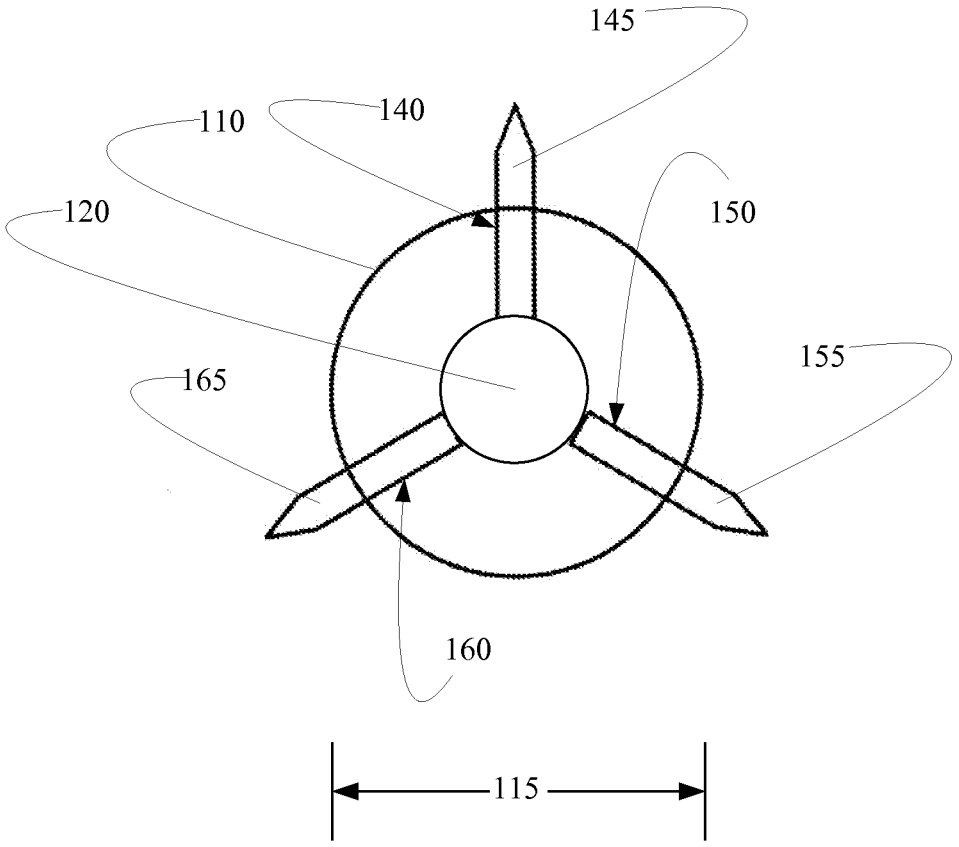
FIG. 2 (PRIOR ART)
FIG. 2 shows a prior art mechanical broadhead in cross section.

Prior art mechanical broadhead devices comprise at least 2 pivotable blades, and as many of 4 pivotable blades. FIG. 2 is a cross section of a prior art mechanical broadhead comprising 3 pivotable blades 140, 150, and 160. As those skilled in the art will appreciate, pivotable blades 140, 150, and 160 each comprise one or more very sharp elements which are designed to lacerate and penetrate a target.

As those skilled in the art will appreciate, any feature or element of an arrow in flight that extends outwardly from the arrow shaft causes aerodynamic drag. In addition, any feature or element of an arrow in flight that extends outwardly from the arrow shaft, other than the fletchings, will likely cause the arrow to rotate erratically while in flight. Moreover, any feature or element of an arrow in flight that extends outwardly from the arrow shaft, other than the fletchings, will likely cause the arrow to veer from an intended trajectory. Such a deviation may be a lateral deviation, and/or an upward deviation, and/or a downward deviation. Needless to say, any feature or element of an arrow in flight that extends outwardly from the arrow shaft, other than the fletchings, will result in the arrow missing its intended target.

A mechanical broadhead is more streamlined, and therefore, has less aerodynamic drag in flight than does a fixed broadhead. Nevertheless, prior art mechanical broadhead 105 comprises a plurality of elements 145, 155, and 165, extending outwardly from the non-deployed broadhead 105 beyond diameter 115 of arrow shaft 110. Each such extending element 145, 155, and 165, adds incremental aerodynamic drag to arrow 100 when in flight, and can cause a course deviation resulting in a missed target.

In addition, arrows equipped with prior art mechanical broadheads necessarily comprise exposed, sharp, cutting elements extending outwardly from the outer surface of an arrow shaft prior to impact of the arrow with a target. Each such exposed cutting element is capable of cutting a bow string, an operator, or a bystander, through casual contact with, or handling of, the arrow.

Referring now to FIGS. 3A, 3B, 3C, and 3D, Applicant's mechanical broadhead 300 comprises a plurality of pivotable blades 340 and 350 (and optionally blade 360 (FIG. 4) disposed within cover 310. Broadhead subassembly 305 comprises a broadhead shaft 370 comprising an outer diameter 375.

Figure 3A:
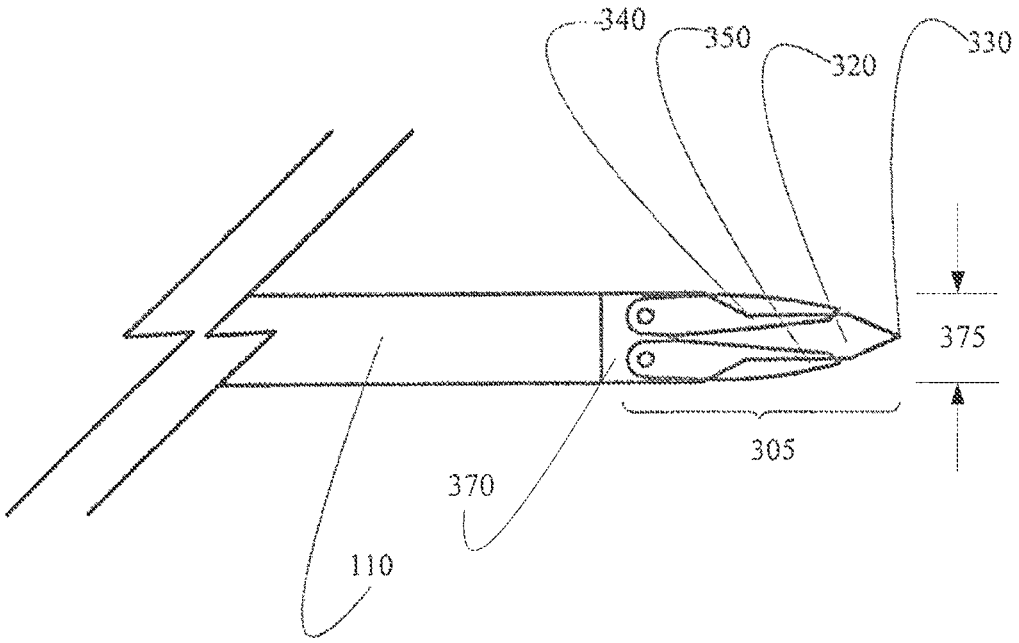
FIGS. 3A, 3B, 3C, and 3D, illustrate a first embodiment of Applicant's broadhead device.
Figure 3B:
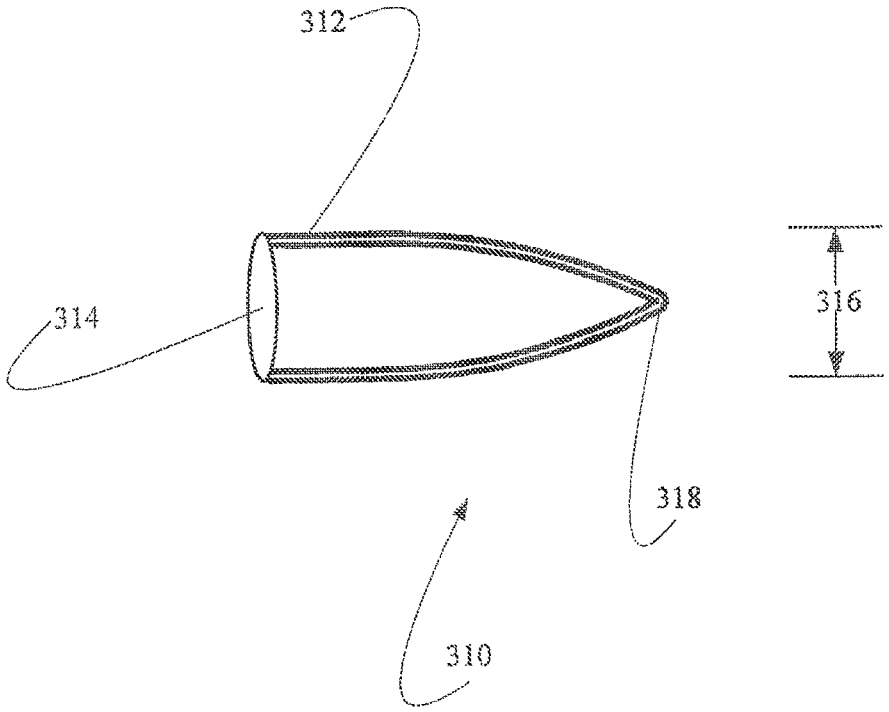
Figure 3C:
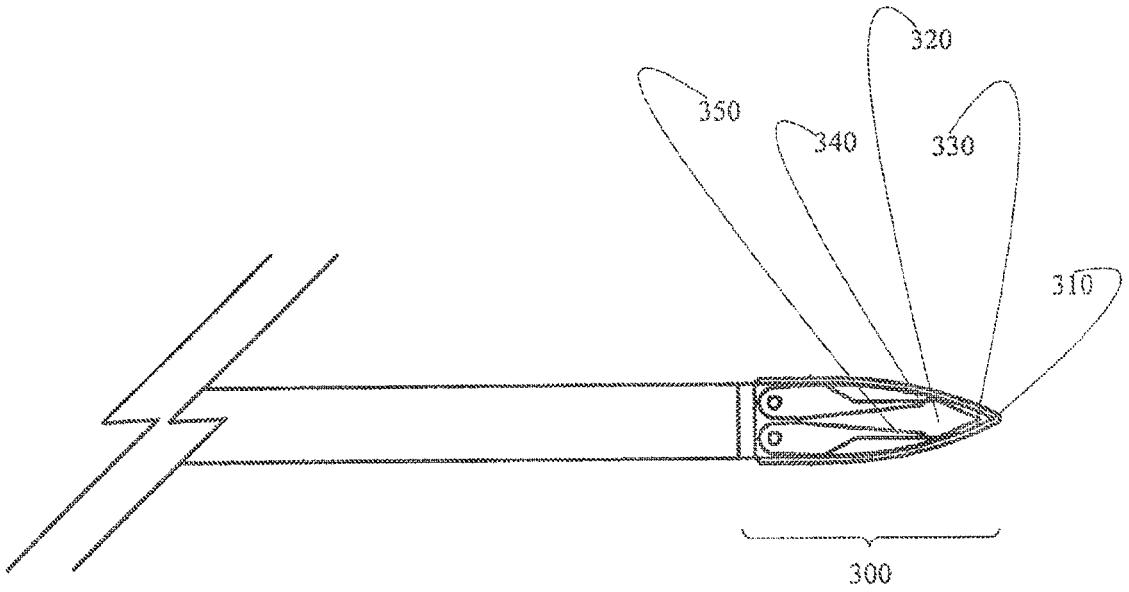

Cover 310 comprises a conical-shaped material 312 formed to include an open end 314. Material 312 tapers from open end 314 to a point at end 318. Cover 310 comprises a maximum outer diameter 316 at open end 314. Cover 310 (FIG. 3B) is disposed over subassembly 305 (FIG. 3A) to form Applicant's broadhead device 300 (FIG. 3C). In certain embodiments, maximum outer diameter 316 of cover 310 is not more than twenty-five percent (25%) greater than outer diameter 375 (FIG. 3A) of broadhead shaft 370 (FIG. 3A).

Figure 4:
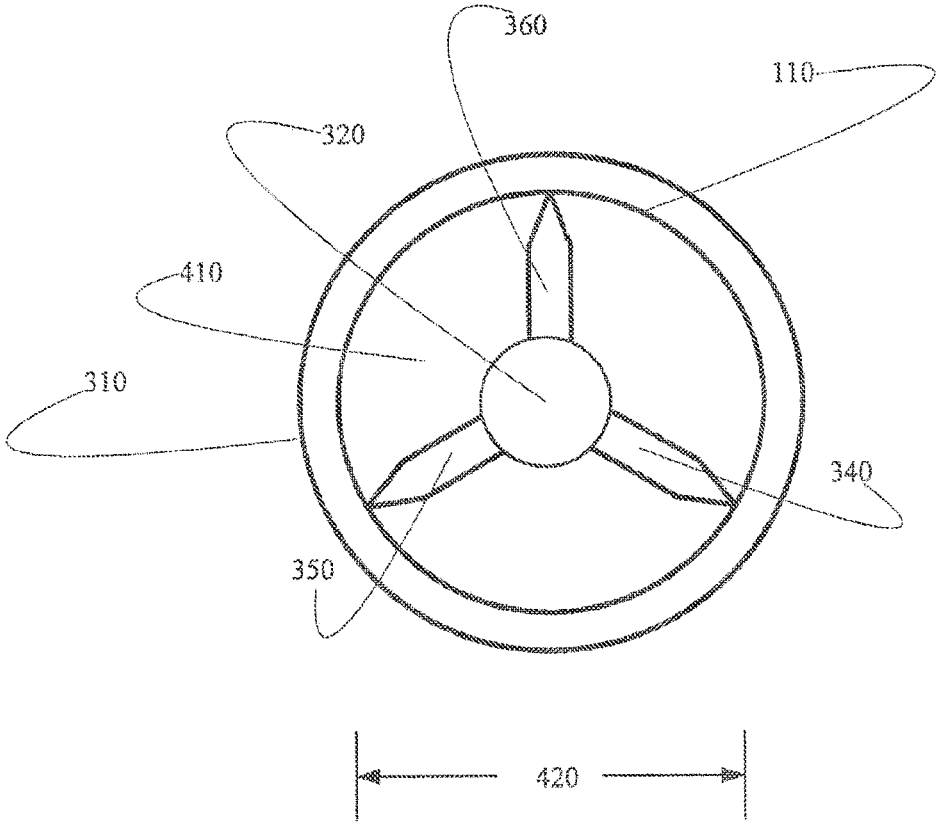
FIG. 4 shows Applicant's mechanical broadhead in cross section.

In the illustrated embodiment of FIG. 4, cover 310 defines an enclosed space 410. Each of rotatable blades 340, 350, and 360, when in a nested configuration, i.e. such as in flight or prior to flight, are completely disposed within enclosed space 410.

Figure 3D:
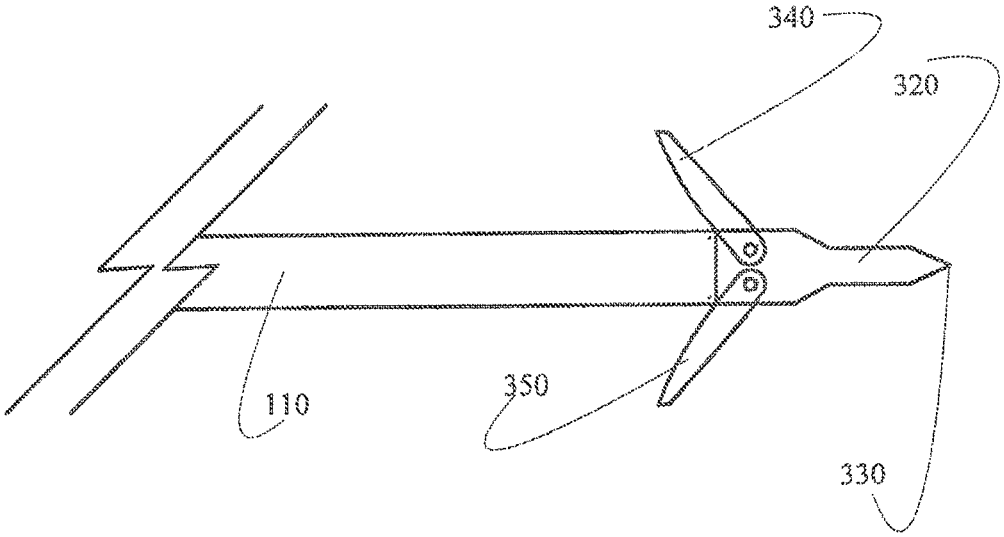

In certain embodiments, material 312 comprises a polymeric material. Upon impact with a target, point 330 of central, non-pivotable blade 320 penetrates cover 310. Further upon impact, each of the plurality of pivotable blades 340, 350, and optionally 360, slices through polymeric material 312 to extend outwardly from shaft 110, as shown in FIG. 3D.

In certain embodiments, the polymeric material 312 comprises a low cut growth resistance determined using ASTM D3629-99. In certain embodiments, the polymeric material 312 comprises a cut growth resistance of less than about 1,000 kilocycles per inch of growth. In certain embodiments, the polymeric material 312 comprises a polybutadiene elastomer.

Figure 3E:
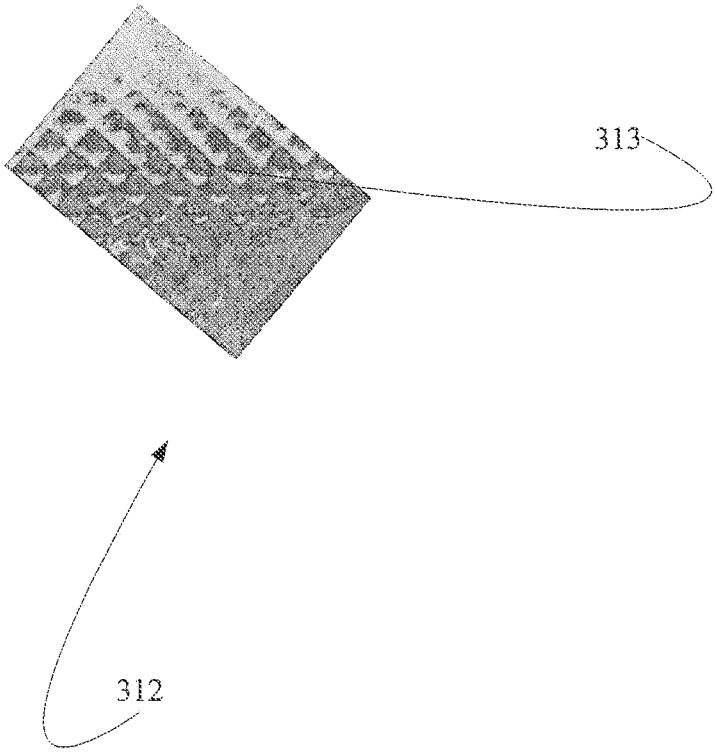
FIG. 3E shows a polymeric material formed to include an integral drag reducing surface texture.

In certain embodiments, cover 310 is formed by injection molding. In certain embodiments, cover 310 is formed to include a drag reducing surface texture. To create the coating, the researchers used beams of infrared light to heat certain spots on wet coatings made of tiny plastic particles in water. As the hotter spots evaporate more quickly, the plastic particles are then guided there as the evaporating water is replaced. The process is called infrared radiation-assisted evaporative lithography. FIG. 3E illustrates a polymeric material 312 comprising an integral drag reducing surface texture comprising a plurality of surface dimples.

In certain embodiments, material 312 comprises a frangible material. A material is said to be frangible if through deformation it tends to break up into fragments, rather than deforming plastically and retaining its cohesion as a single object. Upon impact with a target, point 330 of central, non-pivotable blade 320 shatters frangible cover 310. Further upon impact, each of the plurality of pivotable blades 340, 350, and optionally 360, shatters frangible material 312 to extend outwardly from shaft 110, as shown in FIG. 3D. Upon impact, frangible material 312 breaks into pieces which are shed from the mechanical portions of broadhead 300 thereby allowing each of the plurality of pivotable blades to extend outwardly from shaft 110.

In certain embodiments, Applicant's frangible cover is formed from (N) different portions that upon impact break apart from one another somewhat akin to flower pedals. In certain embodiments, (N) is two or more.

In certain embodiments, Applicant's frangible cover is formed from a polymeric material, although not a polymeric elastomer. In certain embodiments, the frangible cover is formed from an acrylic resin. In certain embodiments, the frangible cover is formed from between more than 2 separate portions each formed from an acrylic resin.

In certain embodiments, the frangible cover is formed from a polystyrene resin. In certain embodiments, the frangible cover is formed from more than 2 separate portions each formed from a polystyrene resin.

In certain embodiments, the frangible material 312 comprises a plurality of hollow glass microspheres in an adhesive continuous phase. In certain embodiments, each of such hollow glass microspheres comprises a diameter of between about 10 microns to about 300 microns. Upon impact with a target, the attached plurality of hollow glass microspheres break into individual microspheres and fall away from shaft 310 thereby allowing each of the plurality of pivotable blades to extend outwardly from shaft 110, as shown in FIG. 4.

In certain embodiments, frangible material 312 comprises a powdered ceramic that has been densified to form a brittle network. Upon impact with a target, the ceramic encapsulant breaks into individual ceramic particles, and falls away from shaft 310 thereby allowing each of the plurality of pivotable blades to extend outwardly from shaft 110, as shown in FIG. 4.

Prior to striking a target, the plurality of blades are completely disposed within cover 310. Until impact with a target, each cutting element comprising Applicant's broadhead device is disposed under cover 310, and therefore, each cutting element is prevented from cutting a bow string, an operator, or a bystander, through casual contact with, or handling of, an arrow equipped with Applicant's broadhead device 300.

An arrow equipped with Applicant's broadhead device 300 has an aerodynamic profile that mimics an aerodynamic profile as does an arrow equipped with a target point or a field point. There is no contact between any portion of any of the pivotable blade elements of Applicant's broadhead device and ambient air when an arrow equipped with Applicant's broadhead device is in flight.

Figure 5:
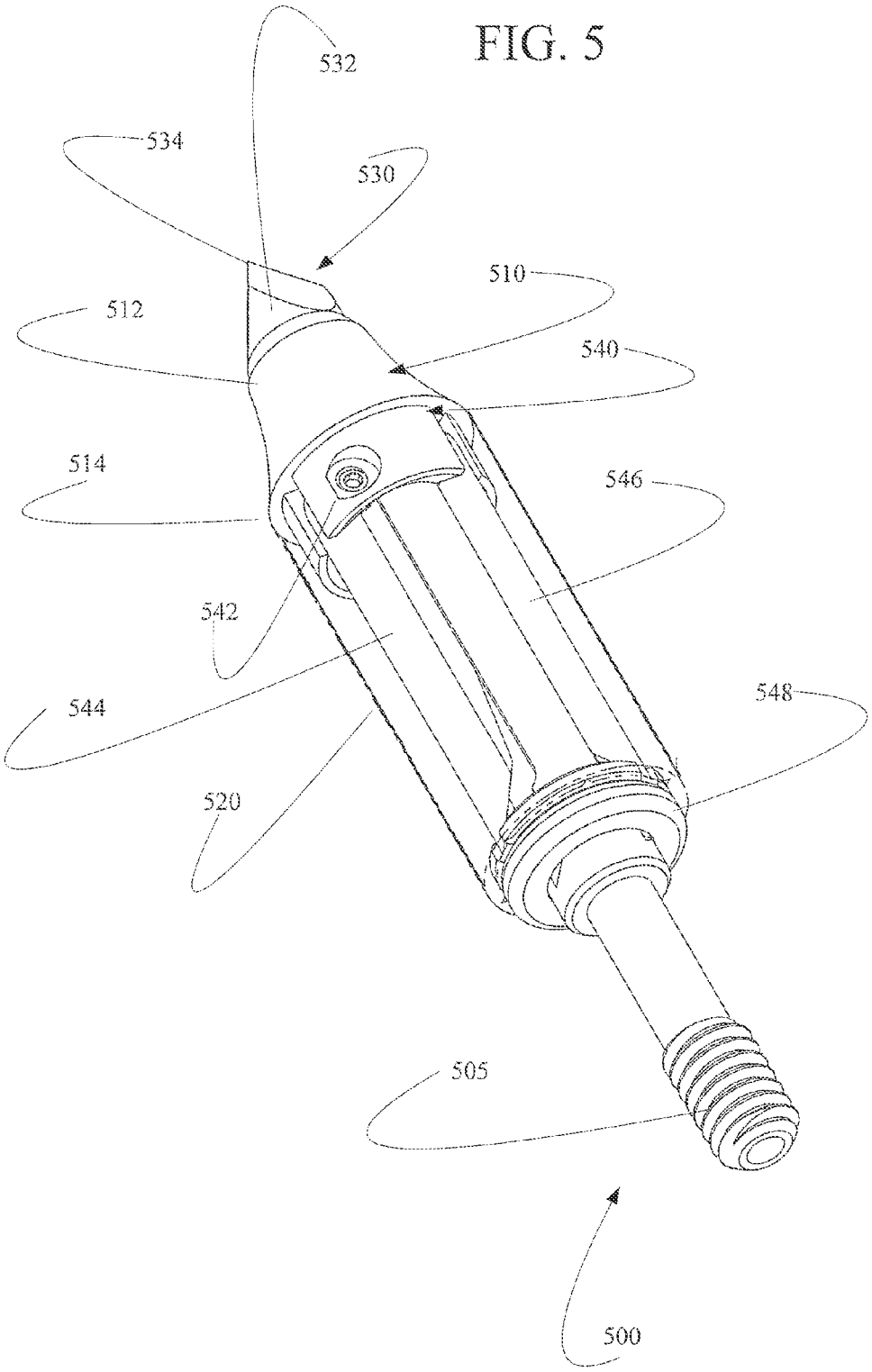
FIG. 5 illustrates a second embodiment of Applicant's broadhead device comprising a plurality of pivotable blades in a nested configuration.
Figure 6:
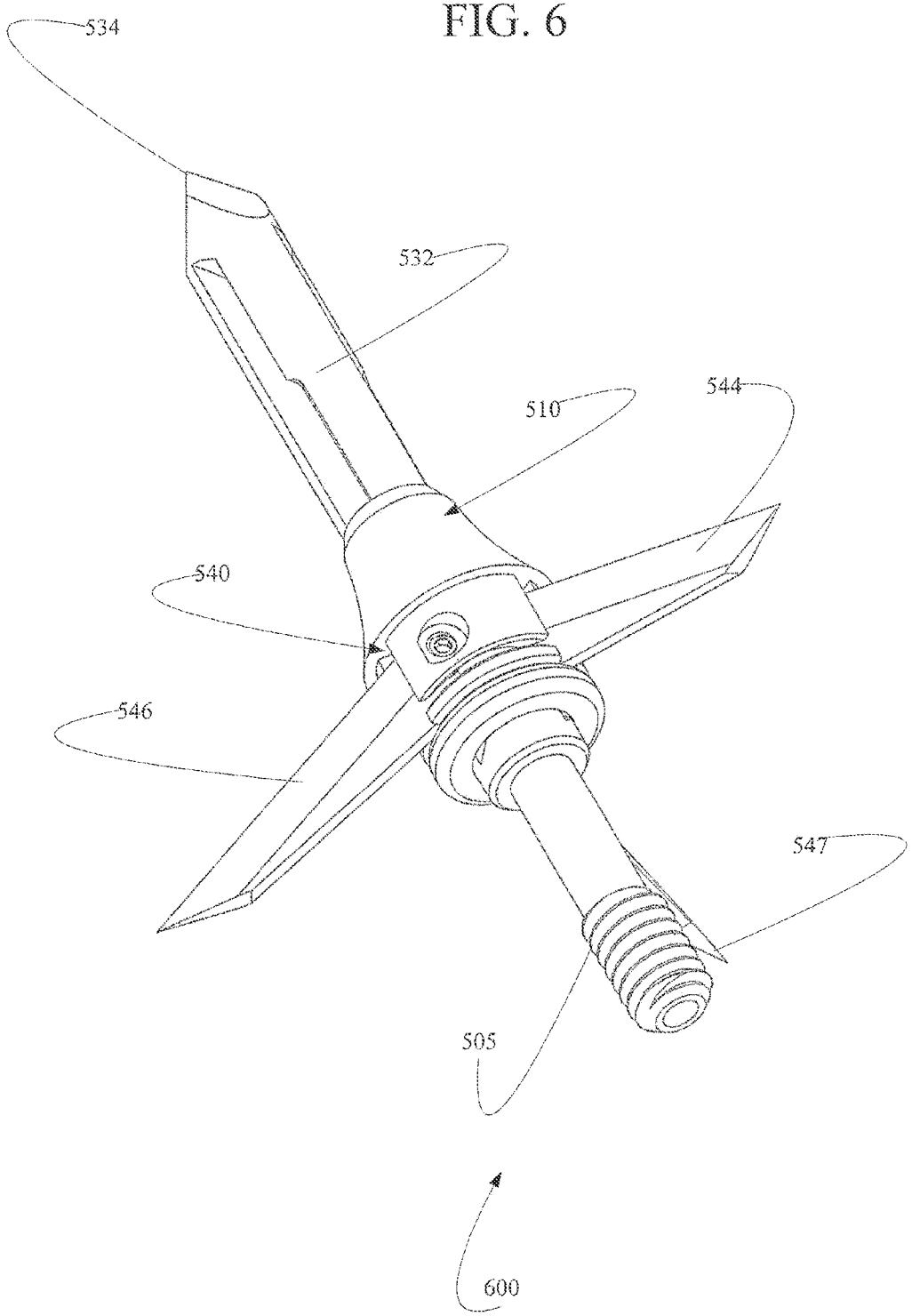
FIG. 6 illustrates the broadhead device of FIG. 5 with a plurality of pivotable blades in an extended configuration.

Referring now to FIGS. 5 and 6, Applicant's broadhead device 500 comprises an arrow tip assembly 530 and a moveable, bell-shaped collar 510 having a narrow diameter end 512 disposed adjacent a bottom portion 532 of arrow tip assembly 530. Arrow tip assembly 530 comprises a shaft 532 and a tip 534 formed on the distal end of shaft 532.

Blade extension assembly 540 is disposed adjacent end 514 of collar 510 in the nested configuration shown in FIG. 5. Blade extension assembly 540 comprises a moveable annular ring 542 disposed around shaft 532, and two or more blades 544 and 546 pivotably attached to moveable annular ring 542. Annular base plate 548 is disposed around shaft 530 at a distal end of blade extension assembly 540. Shaft 532 extends upwardly from base plate 548.

In the illustrated embodiment of FIG. 5, cover 520 comprises a tubular member disposed between end 514 of collar 510 and base plate 548. In certain embodiments, tubular member 520 is formed from a polymeric material comprising a low cut growth resistance. Upon impact with a target, point 534 and distal end of shaft 532 penetrate the target thereby moving collar 510 downwardly, as shown in FIG. 6. Further upon impact, each of the plurality of pivotable blades 544, 546, and optionally 547 (FIG. 6), is caused to rotate to the extended configuration of FIG. 6 from the nested configuration of FIG. 5, thereby slicing through cover 520 to extend outwardly.

In other embodiments, cover 520 is formed from a frangible material, as described hereinabove. Upon impact with a target, point 534 and distal end of shaft 532 penetrate the target thereby moving collar 510 downwardly, as shown in FIG. 6, and shattering the frangible cover 520. The frangible cover 520 breaks into pieces which are shed from the mechanical portions of broadhead 500 thereby allowing each of the plurality of pivotable blades to extend outwardly as shown in FIG. 6.

Referring now to FIGS. 1A, 2, 3C, and 4, FIG. 2 shows prior art broadhead device 100 in cross section. Portions 145, 155, and 165, of pivotable blades 140, 150, and 160, respectively, extend outwardly from arrow shaft 110 even when those pivotable blades are in the non-deployed configuration of FIG. 1A.

FIG. 4 shows Applicant's broadhead device 300 wherein no portion of any of pivotable cutting blades 340, 350, and 360, extend outwardly from arrow shaft 110 when those pivotable blades are in the nested configuration of FIG. 3C.

Unlike use of prior art mechanical broadhead device 100, when in flight an arrow equipped with Applicant's broadhead device 300 is subject to no incremental aerodynamic drag resulting from portions of the broadhead device extending outwardly from the outer surface of the arrow shaft. As a result, an arrow equipped with Applicant's broadhead device 300 is not subject to the sorts of course deviations caused by prior art broadhead devices.

While the preferred embodiments of the present invention have been illustrated in detail, it should be apparent that modifications and adaptations to those embodiments may occur to one skilled in the art without departing from the scope of the present invention as set forth herein.

I claim:

1. A mechanical broadhead device, comprising:

a plurality of blades pivotably attached to a broadhead shaft comprising a broadhead shaft diameter;

a cover having a conical shape and formed to include an open end, and further comprising a maximum outer cover diameter at said open end, wherein said maximum outer cover diameter is not more than twenty-five percent greater than said broadhead shaft diameter;

wherein:

said plurality of blades and said shaft are disposed within said cover; and there is no contact between any portion of any of the plurality of pivotable blades and ambient air.

2. The mechanical broadhead device of claim 1, wherein said plurality of pivotable blades are each moveable between a nested configuration and an extended configuration, wherein said cover holds said plurality of pivotable blades in said nested configuration until impact with a target.

3. The mechanical broadhead device of claim 1, wherein:

said shaft comprises a shaft diameter;

said plurality of pivotable blades comprises a nested diameter when disposed in said nested configuration;

said nested diameter is greater than said shaft diameter by twenty-five percent or less.

4. The mechanical broadhead device of claim 1, wherein each f said plurality of pivotable blades is prevented from cutting a bow string, an operator, or a bystander, through contact with, or handling of, an arrow equipped with said mechanical broadhead device.

5. The mechanical broadhead device of claim 1, wherein an arrow comprising said mechanical broadhead device attached to an arrow shaft has an aerodynamic profile in flight that mimics an aerodynamic profile of an arrow comprising a target or field point.

6. The mechanical broadhead device of claim 1, wherein said cover is formed from a polymeric material.

7. The mechanical broadhead device of claim 6, wherein said polymeric material comprises a cut growth resistance of less than about 1,000 kilocycles per inch of growth.

8. The mechanical broadhead device of claim 6, wherein said polymeric material comprises a polybutadiene elastomer.

9. The mechanical broadhead device of claim 6, wherein said polymeric material is formed to include an integral drag reducing surface texture.

10. The mechanical broadhead device of claim 1, wherein said cover is formed from a frangible material.

11. The mechanical broadhead device of claim 10, wherein said cover is formed from a powdered ceramic that has been densified to form a brittle network.

12. The mechanical broadhead device of claim 10, wherein said cover is formed to include an integral drag reducing surface texture.

13. The mechanical broadhead device of claim 10, wherein said cover is formed from a plurality of hollow glass microspheres disposed in an adhesive continuous phase.

14. The mechanical broadhead device of claim 1, further comprising:

a point disposed on a distal end of said shaft;

wherein said point is disposed within said cover.

15. A mechanical broadhead device, comprising:

a point disposed on a distal end of a shaft;

a plurality of blades pivotably attached to a moveable collar disposed around said shaft;

a cover;

wherein:

said cover comprises a tubular member; and said point is not disposed within said cover.

16. The mechanical broadhead device of claim 15, wherein said cover is formed from a polymeric material.

17. The mechanical broadhead device of claim 16, wherein said polymeric material is formed to include an integral drag reducing surface texture.

18. The mechanical broadhead device of claim 16, wherein said cover comprises a cut growth resistance of less than about 1,000 kilocycles per inch of growth.

19. The mechanical broadhead device of claim 16, wherein said polymeric material comprises a polybutadiene elastomer.

20. The mechanical broadhead device of claim 15, wherein said cover is formed from a frangible material.

21. The mechanical broadhead device of claim 20, wherein said cover is formed from a powdered ceramic that has been densified to form a brittle network.

22. The mechanical broadhead device of claim 20, wherein said cover is formed to include an integral drag reducing surface texture.

23. The mechanical broadhead device of claim 20, wherein said cover is formed from a plurality of hollow glass microspheres disposed in an adhesive continuous phase.

* * * * *